US007925173B2

(12) United States Patent
Yamada

(10) Patent No.: US 7,925,173 B2
(45) Date of Patent: Apr. 12, 2011

(54) MONITORING APPARATUS, IMAGE FORMING APPARATUS, AND IMAGE FORMING SYSTEM

(75) Inventor: Akihiro Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 138 days.

(21) Appl. No.: 11/645,183

(22) Filed: Dec. 26, 2006

(65) Prior Publication Data

US 2007/0147854 A1 Jun. 28, 2007

(30) Foreign Application Priority Data

Dec. 27, 2005 (JP) ..... 2005-375594

(51) Int. Cl.
*G03G 15/08* (2006.01)

(52) U.S. Cl. ..... 399/27

(58) Field of Classification Search ..... 399/24, 399/27

See application file for complete search history.

(56) References Cited

U.S. PATENT DOCUMENTS 5,950,043 A * 9/1999 Fujita et al. ..... 399/60
6,507,409 B2 * 1/2003 Kawaguchi ..... 358/1.16
6,546,212 B1 4/2003 Ogata et al.
2003/0053809 A1 3/2003 Ogata et al.
2004/0213592 A1 * 10/2004 Rodriguez ..... 399/24
2005/0147421 A1 * 7/2005 Nakashima ..... 399/23
2006/0228123 A1 * 10/2006 Zaima ..... 399/24

FOREIGN PATENT DOCUMENTS

EP 1076270 A2 * 2/2001
JP A 8-211792 8/1996
JP A 10-149065 6/1998
JP A 2000-135842 5/2000
JP A 2001-117446 4/2001
JP A-2002-007081 1/2002
JP A 2002-40877 2/2002
JP A-2005-277747 10/2005

OTHER PUBLICATIONS

Office Action dispatched on Jun. 1, 2010 in Japanese Patent Application No. 2005-375594, with partial translation.

* cited by examiner

*Primary Examiner* — David M Gray
*Assistant Examiner* — Andrew V Do
(74) *Attorney, Agent, or Firm* — Oliff & Berridge, PLC

(57) ABSTRACT

A monitoring apparatus includes a determining unit that determines in advance a first target amount, which is determined as a target of consumption amount of a colorant at a first timing, at which a first predetermined period from start of use of the colorant in image formation has elapsed, a first calculating unit that calculates an actual amount of the colorant actually consumed during the first predetermined period, and an announcing unit that announces consumption status information generated based on the first target amount and the actual amount.

10 Claims, 8 Drawing Sheets

FIG. 7A

| | |
|---|---|
| TIME PERIOD : 1 MONTH,<br>USAGE AMOUNT: 100% | DISPLAY OF<br>TARGET VALUES |

FIG. 7B

| | |
|---|---|
| 3.3% PER DAY<br>23% PER 7DAYS | DISPLAY OF<br>CONSUMPTION RATE |

FIG. 7C

| | |
|---|---|
| SETTING 3.3% PER DAY<br>USAGE 5.7% PER DAY<br>USAGE AMOUNT IS<br>1.7 TIMES SETTING | DISPLAY OF CONSUMPTION<br>STATUS INFORMATION |

FIG. 7D

| | |
|---|---|
| SUPPRESS USAGE<br>AMOUNT TO<br>2.8% PER DAY<br>20% PER 7DAYS | DISPLAY OF<br>ADVICE INFORMATION |

FIG. 7E

| | |
|---|---|
| OPERATION MODE :<br>NORMAL | DISPLAY OF<br>OPERATION MODE |

MONITORING APPARATUS, IMAGE FORMING APPARATUS, AND IMAGE FORMING SYSTEM

CROSS-REFERENCE TO THE RELATED APPLICATION

This application is based upon and claims priority from prior Japanese Patent Application No. 2005-375594 filed on Dec. 27, 2005, the entire contents of which are incorporated herein by reference.

TECHNICAL FIELD

Aspects of the present invention relate to a monitoring apparatus which monitors a consumption state of a colorant that is accommodated in a colorant cartridge and used in printing of an image, and also to an image forming apparatus and image forming system which have such a monitoring apparatus.

BACKGROUND

Conventionally, an apparatus is known in which, during a period between start of use of a toner cartridge and at a time immediately before replacement of the toner cartridge, relationships (a consumption pattern) between the number of printed sheets or the amount of print data and the consumption amount of a toner are obtained on the basis of a past count result attained by counting the number of printed sheets or the amount of print data. The consumption amount (remaining amount) of the toner is estimated based on the obtained relationships and the present number of printed sheets or amount of print data, and the estimated amount is displayed (for example, see JP-A-2000-135842).

In the above apparatus, however, the current consumption state of the toner can be simply known. In the case where, for example, the replacement interval of the toner cartridge is strictly specified in order to attain toner savings, there are problems in that it is not known whether the toner can be used under the present consumption rate until the next replacement timing or not, and that a toner consumption rate at which the toner is maintained to be serviceable until the next replacement timing cannot be known.

Aspects of the present invention provide a monitoring apparatus, image forming apparatus, and image forming system which can allow the user to know the consumption rate of a colorant (a toner, an ink, or the like).

According to an aspect of the invention, there is provided a monitoring apparatus including; a determining unit that determines in advance a first target amount, which is determined as a target of consumption amount of a colorant at a first timing, at which a first predetermined period from start of use of the colorant in image formation has elapsed; a first calculating unit that calculates an actual amount of the colorant actually consumed during the first predetermined period; and an announcing unit that announces consumption status information generated based on the first target amount and the actual amount.

According to another aspect of the invention, there is provided an image forming apparatus including: a colorant cartridge that accommodates a colorant; a printing unit that prints an image onto a recording medium by using the colorant; a determining unit that determines in advance a first target amount, which is determined as a target of consumption amount of the colorant at a first timing, at which a first predetermined period from start of use of the colorant in image formation has elapsed; a first calculating unit that calculates an actual amount of the colorant actually consumed during the first predetermined period; and an announcing unit that announces consumption status information generated based on the first target amount and the actual amount.

According to another aspect of the invention, there is provided an image forming system including: an image forming apparatus including a colorant cartridge which accommodates a colorant, and a printing unit that prints an image onto a recording medium by using the colorant; an information processing apparatus which performs data communication with the image forming apparatus; a determining unit that determines in advance a first target amount, which is determined as a target of consumption amount of the colorant at a first timing, at which a first predetermined period from start of use of the colorant in image formation has elapsed; a first calculating unit that calculates an actual amount of the colorant actually consumed during the first predetermined period; and an announcing unit that announces consumption status information generated based on the first target amount and the actual amount.

BRIEF DESCRIPTION OF THE DRAWINGS

FIGS. 7A to 7E are diagrams showing an example of a display in an announcing unit;

DETAILED DESCRIPTION

Hereinafter, aspects of the invention will be described with reference to the accompanying drawings.

The configuration of main portions of a laser printer 1 that is an image forming apparatus to which an exemplary aspect of the present invention is applied will be described with reference to a block diagram shown in FIGS. 1A and 1B.

Figure 1A:
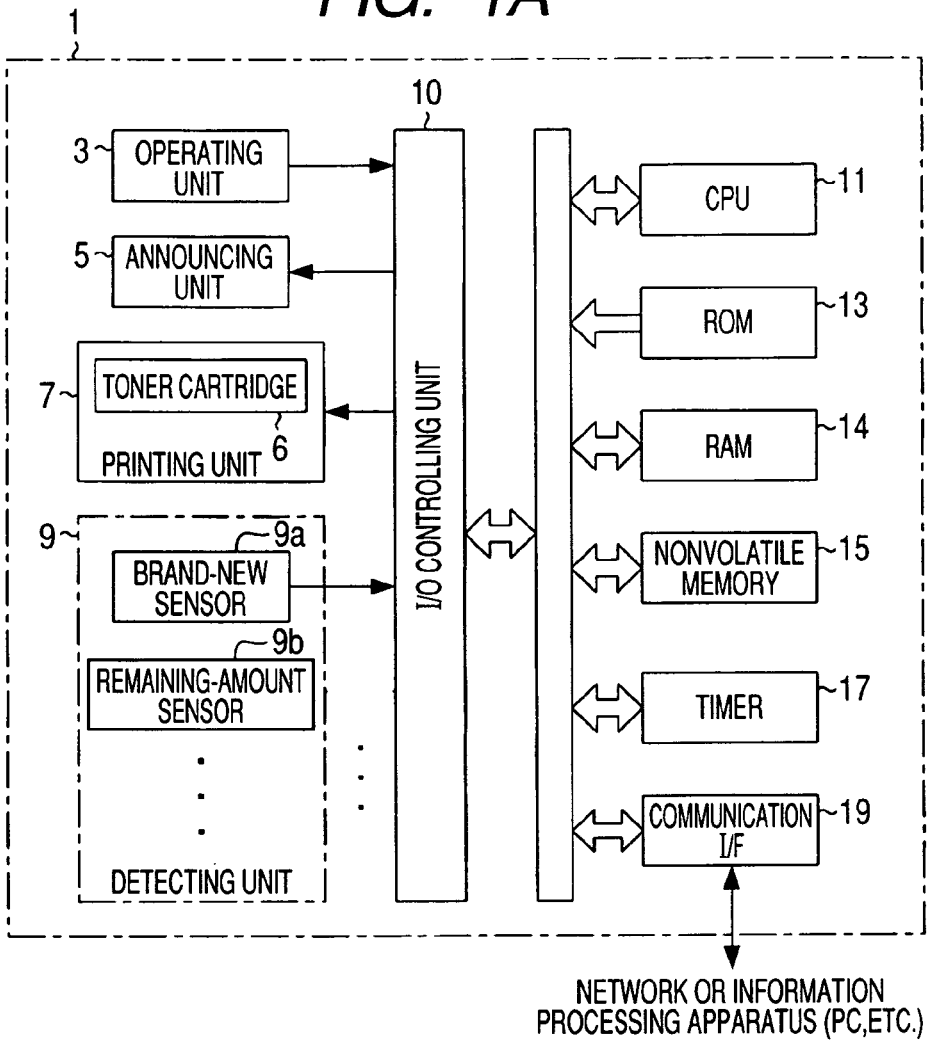
FIGS. 1A and 1B are block diagrams showing the configuration of a printer to which an exemplary aspect of the present invention is applied.

FIG. 1A is a block diagram showing the configuration of main portions of the laser printer 1.

The laser printer (hereinafter, referred to simply as "printer") 1 comprises plural detachable toner cartridges (colorant cartridges) 6 which accommodate toners (colorants) of different colors, and performs color printing in response to a print request which is supplied through a network or a signal cable.

As shown in FIG. 1A, the printer 1 comprises: an operating unit 3 which is configured by a ten-key pad, cursor keys, and the like, and through which various commands are to be input; an announcing unit 5 which comprises a display device for displaying characters and graphics, a speaker for producing sounds or a warning beep, etc., and which announces visually or audibly the status of the printer 1 and the like to the user; a printing unit 7 which prints images and characters on a recording medium (for example, a recording sheet) by using the toner cartridges 6; a detecting unit 9 which detects statuses of components constituting the printer 1; an I/O controlling unit 10 which receives signals from the operating unit 3 and the detecting unit 9, and which produces driving signals for the announcing unit 5 and the printing unit 7; a timer 17 which measures time; a communication I/F 19 which communicates with external information processing apparatuses (for example, a personal computer) through a network or a signal cable; a CPU 11 which executes various processes in accordance with commands that are received from the external information processing apparatuses through the communication I/F 19, and that are input from the operating unit 3 through the I/O controlling unit 10; a ROM 13 which stores programs to be executed by the CPU 11, and the like; a RAM 14 which is used as a work area when the CPU 11 executes various processes; and a nonvolatile memory 15 which stores control parameters required when the CPU 11 executes various processes, and the like.

The printing unit 7 is configured so as to operate in one of three modes; a normal mode where normal printing is performed; a toner save mode where printing in which the dot density is reduced is performed to suppress the consumption amount of the toner; and an inhibition mode where printing is not performed even when the print request is issued.

The detecting unit 9 comprises at least a brand-new sensor 9*a* which detects whether the toner cartridges 6 are brand new or not, i.e., whether the toner cartridges 6 are replaced or not.

The timer 17 is configured so as to continuously measure the elapsed time period from the time of activation of the timer, irrespective of whether the printer 1 is powered on or not.

Figure 1B:
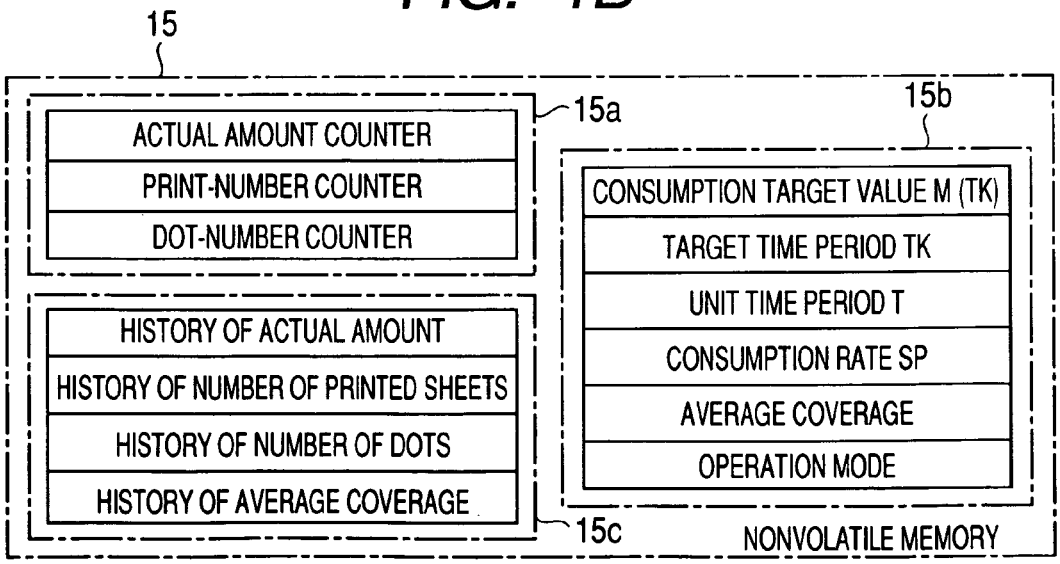

In the nonvolatile memory 15, as shown in FIG. 1B, at least a counter region 15*a*, a set-value region 15*b*, and a history information region 15*c* are disposed. The counter region 15*a* is used as an actual amount counter which indicates the consumption amount (actual amount) of the toner which has been consumed after the corresponding one of the toner cartridges 6 is mounted, a print-number counter which indicates the number of image formations executed by the printing unit 7, and a dot-number counter which counts the number of dots required in printing by the printing unit 7. The set-value region 15*b* stores a target time period TK serving as the second timing that is set in accordance with operations on the operating unit 3 or an external apparatus connected to the network, a consumption target value M(TK) serving as the second target amount, a unit time period T serving as the third timing, a consumption rate SP (which is calculated from the target time period TK, the consumption target value M(TK); and the unit time period T) an average coverage showing an average value of the toner consumption amount per print sheet, the operation mode of the printing unit 7, and the like. The history information region 15*c* stores histories of the actual amount, the number of printed sheets, the number of dots, etc. The counter region 15*a* and the history information region 15*c* are disposed for each of the toner cartridges 6.

Next, a main process which is executed by the CPU 11 will be described with reference to a flowchart shown in FIG. 2.

This process is activated after the CPU 11 which has been activated by the power-on of the printer 1 performs an initialization process of initializing the components of the printer 1.

Figure 2:
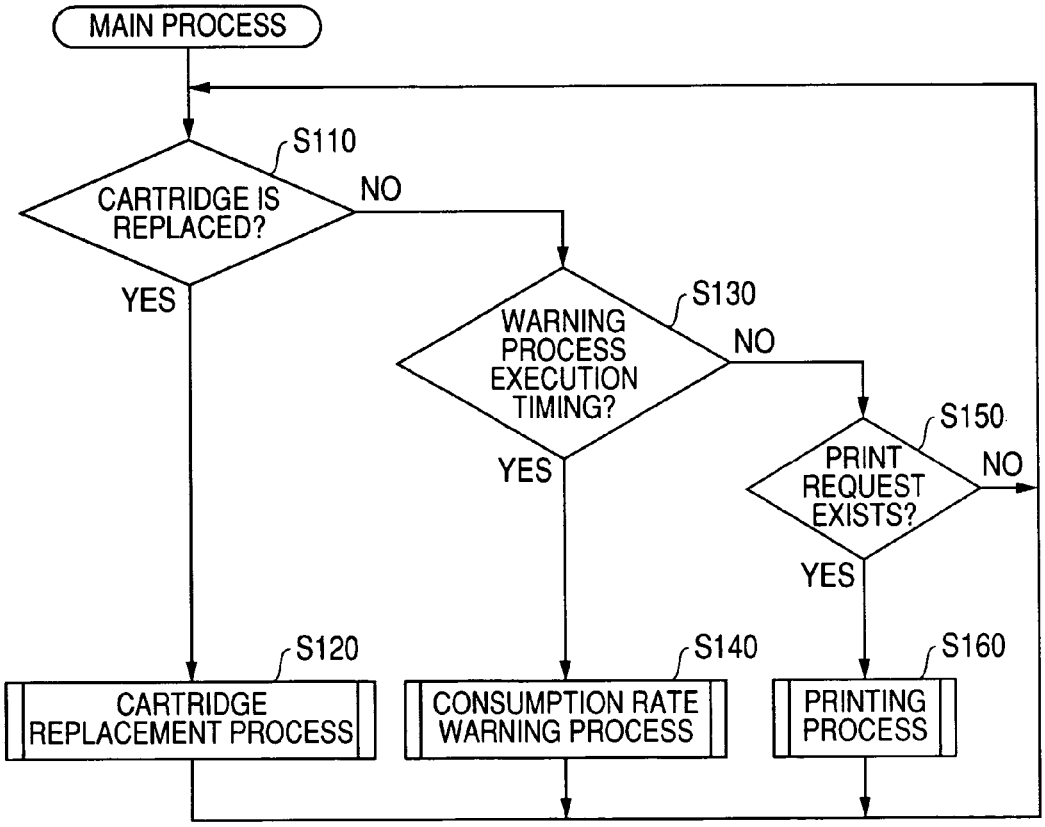
FIG. 2 is a flowchart showing contents of a main process which is executed by a CPU.

When this process is activated, as shown in FIG. 2, it is first determined in S110 whether or not replacement of the toner cartridge 6 has been performed, based on a result of the detection by the brand-new sensor 9*a*.

If it is determined in S110 that replacement of the toner cartridge 6 has been performed, the control transfers to S120 to execute a cartridge replacement process which will be described later, and then returns to S110. By contrast, if it is determined that replacement of the toner cartridge 6 has not been performed, the control transfers to S130 to determine whether or not the timing is a warning process execution timing. The warning process execution timing is a timing which, during a period when the timer 17 measures the time, is generated with setting the unit time period T set in the cartridge replacement process as a cycle.

If it is determined in S130 that the timing is the warning process execution timing, the control transfers to S140 to execute a consumption rate warning process which will be described later, and then returns to S110. By contrast, if it is determined that the timing is not the warning process execution timing, the control transfers to S150 to determine whether or not the print request which is supplied from an external information processing apparatus through the communication I/F 19 exists.

If it is determined in S150 that the print request exists, the control transfers to S160 to execute a printing process which will be described later, and then returns to S110. By contrast, if it is determined that the print request does not exist, the control performs nothing and returns to S110.

Figure 3:
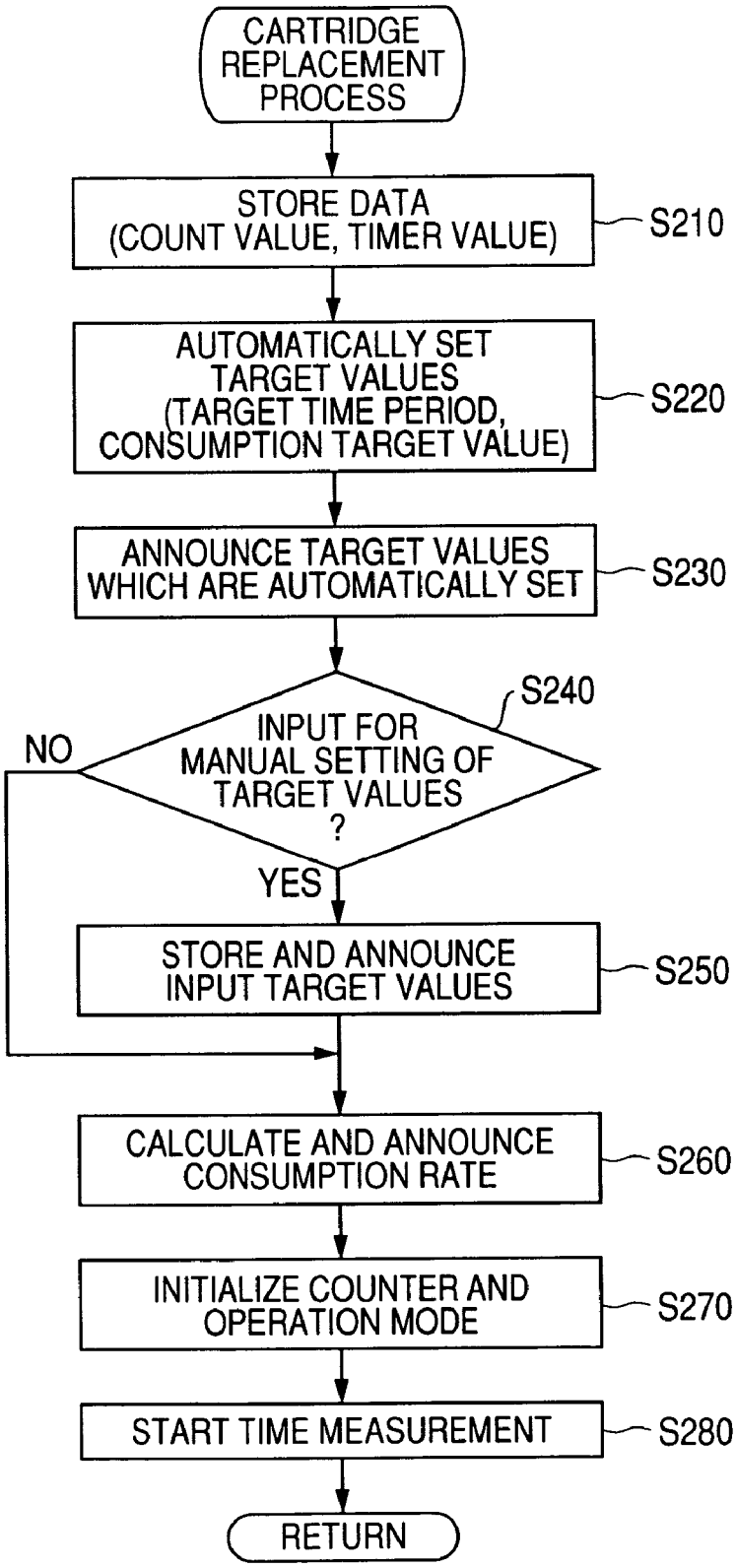
FIG. 3 is a flowchart showing in detail a cartridge replacement process.

Next, the cartridge replacement process which is executed in S120 will be described in detail with reference to a flowchart shown in FIG. 3.

When the cartridge is replaced with a fresh one and this process is activated, count values stored in the counter region 15*a* of the nonvolatile memory 15, and the value of the timer 17 are first moved in S210 into the history information region 15*c* to be stored therein. In S220, thereafter, the target value, i.e., the target time period TK, and the consumption target value M(TK) of the toner which is to be consumed during the target time period TK are automatically set based on, in the stored information, the count value of the actual amount counter (i.e., the actual amount), and the value of the timer 17 (i.e., the usage time period of the toner cartridge 6 which was mounted before the replacement), and the set values are stored into the set-value region 15*b*.

Specifically, when the actual amount (the count value of the actual amount counter) stored in S210 is 100%, for example, the usage time period (the value of the timer 17) stored in S210 is set as the target time period TK. When the actual amount is other than 100%, a time period in which the actual amount will be 100% is obtained from the usage time period, and the obtained time period is set as the target time period TK. Alternatively, the target time period TK and the consumption target value M(TK) may be set to fixed values which are separately designated, without using the stored actual amount and usage time period.

The aspect is configured so that the target time period TK is designated by day, week, or month, and the consumption target value M(TK) is designated as a ratio with respect to the filled amount of the toner of a fresh cartridge which is set to 100%. Alternatively, with respect to the consumption target value M(TK), the actual weight or volume may be designated by the gram or liter.

Subsequently in S230, the announcing unit 5 is controlled so as to announce the target values (the target time period TK and the consumption target value M(TK)) which are set in S220, during a previously set announcing time period (e.g., 3 minutes). Then, the control proceeds to S240

Specifically, as shown in FIG. 7A, for example, "Time period: 1 month, usage amount: 100%" is displayed on the display device constituting the announcing unit 5. This means that the replaced toner cartridge 6 is to be consumed for one month.

In S240, it is determined whether or not an input operation for manual setting of the target value is performed through the operating unit 3 or the communication I/F 19.

When it is determined in S240 that an input operation for manual setting of the target value is not performed, the control proceeds to S260. By contrast, when it is determined in S240 that an input operation for manual setting of the target value is performed, the control transfers to S250 to store the target values (the target time period TK and the consumption target value M(TK)) into the set-value region 15*b*, and perform an announcement based on the target values in place of the announcement in S230 during a prefixed time period (for example, one minute). Thereafter, the control proceeds to S260.

In S260, the consumption rate per unit time period T (M(TK)*T/TK) which is necessary for attaining the target is calculated on the basis of the target time period TK, consumption target value M(TK), and unit time period T which are stored in the set-value region 15*b*, and the result of the calculation is announced (displayed on the display device) by the announcing unit 5.

When the target time period TK is one month (30 days), the consumption target value M(TK) is 100%, and the unit time period T is one day and seven days, for example, the consumption rate per day is 3.3%, and that per seven days is 23%. The rates are displayed as shown in FIG. 7B.

Subsequently in S270, the counter region 15*a* is cleared, and the operation mode which is one of the stored values of the set-value region 15*b* is initialized to the normal mode. Then, the time measurement by the timer 17 is started in S280, and this process is ended.

As a result of executing of this process, each time the toner cartridge 6 is replaced, the usage time period and actual amount of the replaced toner cartridge 6 are stored as histories into the history information region 15*c*, the target time period TK and consumption target value M(TK) of the replaced toner cartridge are set, and the consumption rate SP corresponding to the set target values (the target time period TK and the consumption target value M(TK)) is set. The value of the timer 17 indicates the elapsed time (first timing) t from start of use of the toner cartridge 6 which is currently mounted.

Figure 4:
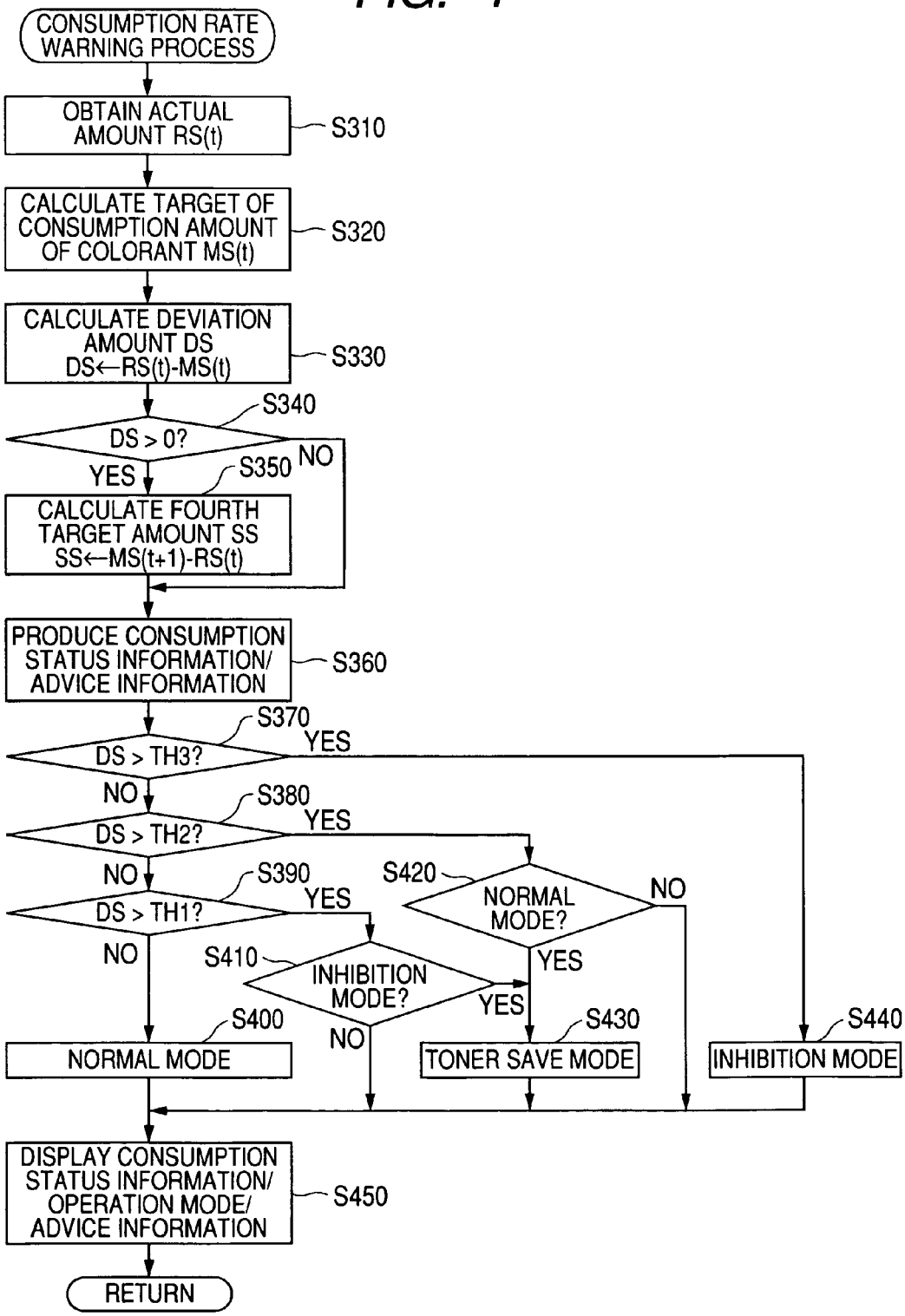
FIG. 4 is a flowchart showing in detail a consumption rate warning process.
Figure 6A:
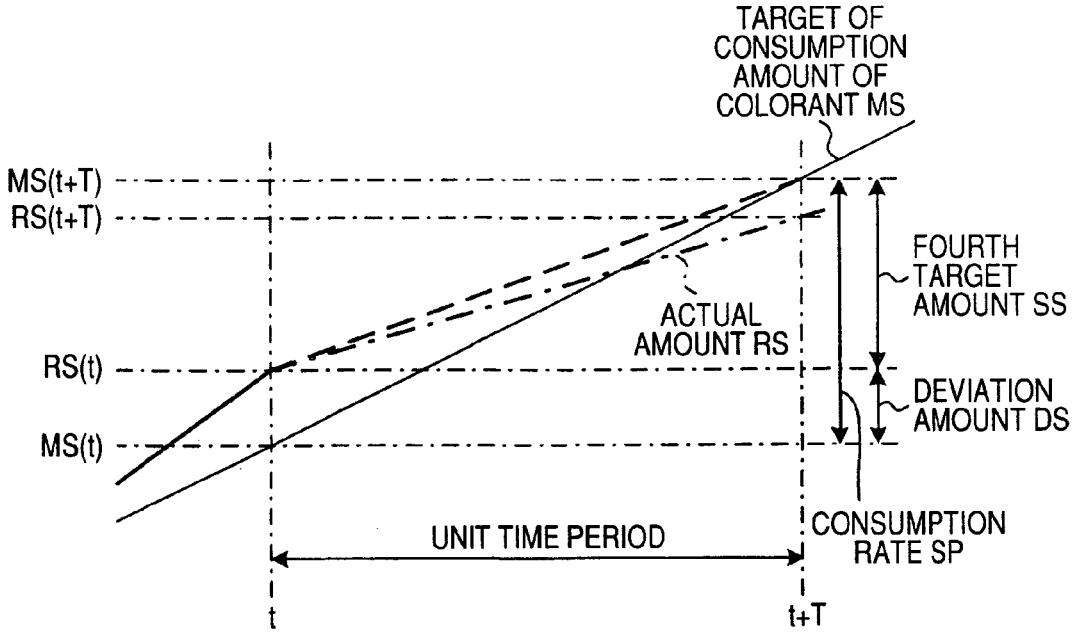
FIGS. 6A and 6B are diagrams showing relationships among parameters.

Next, the consumption rate warning process which is executed in S140 will be described in detail with reference to a flowchart shown in FIG. 4, and also FIGS. 6A and 6B.

As described above, this process is periodically activated each time the unit time period T elapses. In this process, namely, the elapsed time period t after start of use of the mounted toner cartridge 6 is indicated by an integer multiple of the unit time period T.

When this process is activated, an actual amount RS(t) at this timing is obtained in S310. Subsequently in S320, a target of consumption amount of the colorant (first target amount) MS(t) at this timing is calculated on the basis of the consumption rate SP calculated in S260 shown in FIG. 3 which is described above (see FIG. 6A).

The actual amount RS(t) means the count value of the actual amount counter. When the elapsed time period at this timing is indicated by t=i·T(i−1, 2, 3, . . . ), the target of consumption amount of the colorant MS(t) is calculated by MS(t)=i·SP.

Subsequently in S330, the deviation amount (excess amount) DS of the actual amount RS(t) with respect to the target of consumption amount of the colorant MS(t) is calculated (see FIG. 6A) by using expression (1), and the control then proceeds to S340.

$$DS=RS(t)-MS(t) \tag{1}$$

In this aspect, the deviation amount DS is indicated by the difference between the actual amount RS(t) and the target of consumption amount of the colorant MS(t). Alternatively, the deviation amount may be indicated by a ratio of the actual amount RS(t) to the target of consumption amount of the colorant MS(t).

In S340, it is determined whether or not the deviation amount DS calculated in S330 is larger than zero, or whether or not the actual amount RS(t) exceeds the target of consumption amount of the colorant MS(t). If it is determined in S340 that the deviation amount DS is equal to or smaller than zero, the actual amount RS(t) is deemed to fail to reach the target of consumption amount of the colorant MS(t), and the control performs nothing and transfers to S360. By contrast, if it is determined in S340 that the deviation amount DS is larger than zero, the actual amount RS(t) is deemed to exceed the target of consumption amount of the colorant MS(t), and the control transfers to S350 to calculate (see FIG. 6A) a fourth target amount SS which is a target of consumption amount of the colorant restricted to a time period from this timing to a timing when this process is next activated (from this timing to a timing when the unit time period T elapses), by using expression (2) on the basis of a target of consumption amount of the colorant MS(t+T) after the unit time period T from this timing has elapsed, and the actual amount RS(t) at this timing. Thereafter, the control proceeds to S360.

$$SS=MS(t+T)-RS(t) \tag{2}$$

When the actual amount (MS(t+T)−RS(t)) during the time period from this timing to a timing when this process is next activated can be suppressed to the fourth target amount SS or less, the real consumption amount RS(t+T) at the timing when this process is next activated can be made equal to or smaller than the target of consumption amount of the colorant MS(t+T).

In S360, consumption status information is produced on the basis of the actual amount RS(t) and the target of consumption amount of the colorant MS(t), and when the fourth target amount SS has been calculated, advice information is produced on the basis of the fourth target amount SS and the unit time period T. Then, the control proceeds to S370.

Specifically, as the consumption status information, an actual amount RSP(=RS(t)/i) per unit time period T which is obtained from the actual amount RS(t), the consumption rate SP which is a target of consumption amount of the colorant per unit time period T, and a ratio RSP/SP of the two consumption amounts are produced. As the advice information, the fourth target amount SS per unit time period T is produced.

The consumption status information and the advice information are not restricted to those described above. For example, the actual amount RS(t), the target of consumption amount of the colorant MS(t), and the elapsed time period t may not be processed, and may be used as they are, as the consumption status information.

The processes of S310 to S360 are executed for each of the toner cartridges 6, and the consumption status information and the advice information are produced for each of the toner cartridges 6.

Next, it is determined in S370 whether or not the deviation amount DS produced in S330 (the largest one of the plural deviation amounts DS respectively calculated for the toner cartridges 6, and this is applicable also to S380 and S390 below) is larger than a inhibition setting threshold (second threshold) TH3. If it is determined that the deviation amount DS is not larger than the inhibition setting threshold TH3, the control transfers to S380.

In S380, it is determined whether or not the deviation amount DS is larger than a save setting/inhibition canceling threshold (first threshold) TH2. If it is determined that the deviation amount DS is not larger than the save setting/inhibition canceling threshold TH2, the control transfers to S390 to determine whether or not the deviation amount DS is larger than a save canceling threshold TH1.

If it is determined in S390 that the deviation amount DS is not larger than the save canceling threshold TH1, the control transfers to S400 to set the operation mode of the printing unit 7 to the normal mode, and then proceeds to S450. By contrast, if it is determined in S390 that the deviation amount DS is larger than the save canceling threshold TH1, the control transfers to S410 to determine whether or not the current operation mode is the inhibition mode.

If it is determined in S410 that the current operation mode is not the inhibition mode, the control proceeds to S450. If it is determined that the current operation mode is the inhibition mode, the control transfers to S430 to set the operation mode to the toner save mode, and then proceeds to S450.

If it is previously determined in S380 that the deviation amount DS is larger than the save setting/inhibition canceling threshold TH2, the control transfers to S420 to determine whether or not the current operation mode is the normal mode. If it is determined that the current operation mode is not the normal mode, the control performs nothing and proceeds to S450. By contrast, if it is determined that the current operation mode is the normal mode, the control transfers to S430 to set the operation mode to the toner save mode, and then proceeds to S450.

If it is previously determined in S370 that the deviation amount DS is larger than the inhibition setting threshold TH3, the control transfers to S440 to set the operation mode to the inhibition mode, and proceeds to S450.

In S450, the consumption status information and advice information which a reproduced in S360, and the current operation mode are displayed on the announcing unit 5, and this process is ended.

In S450, the consumption status information in the format of FIG. 7C, the advice information in the format of FIG. 7D, and the operation mode in the format of FIG. 7E are sequentially displayed. The consumption status information and the advice information may be announced for each of the toner cartridges 6 (for each of the toner colors), or may be announced only for the toner cartridge 6 in which the deviation amount DS is largest (i.e., the toner that is consumed most rapidly).

Alternatively, the consumption status information, the advice information, and the operation mode may be repeatedly displayed at predetermined time intervals in addition to the process of S450, or may be displayed in response to a command issued by the user.

Figure 6B:
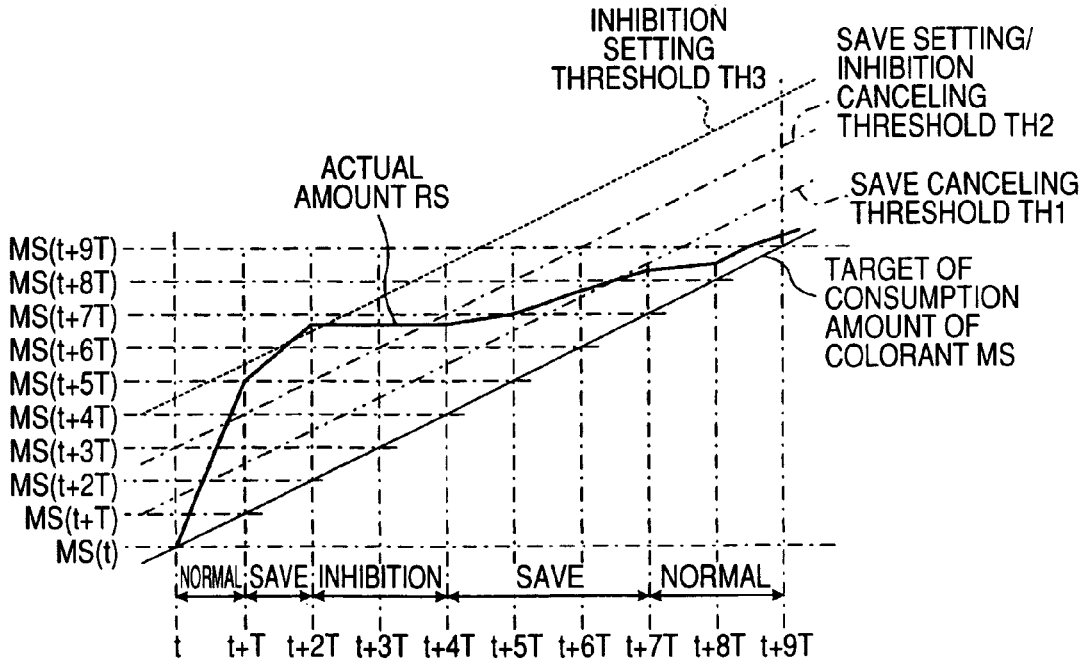
Figure 8:
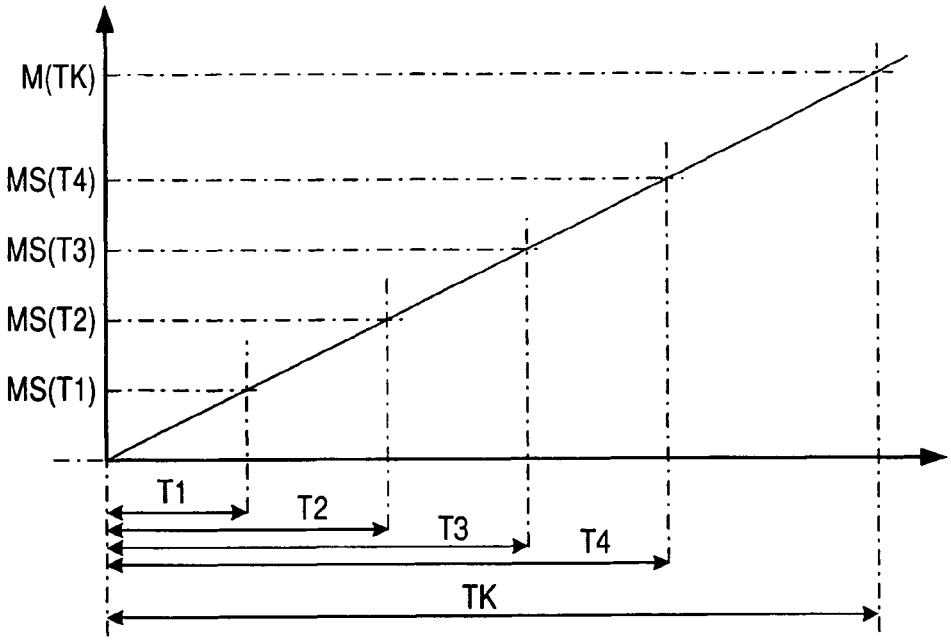
FIG. 8 is a graph showing relationships between set time periods and a target of consumption amount of a colorant.
Figure 9:
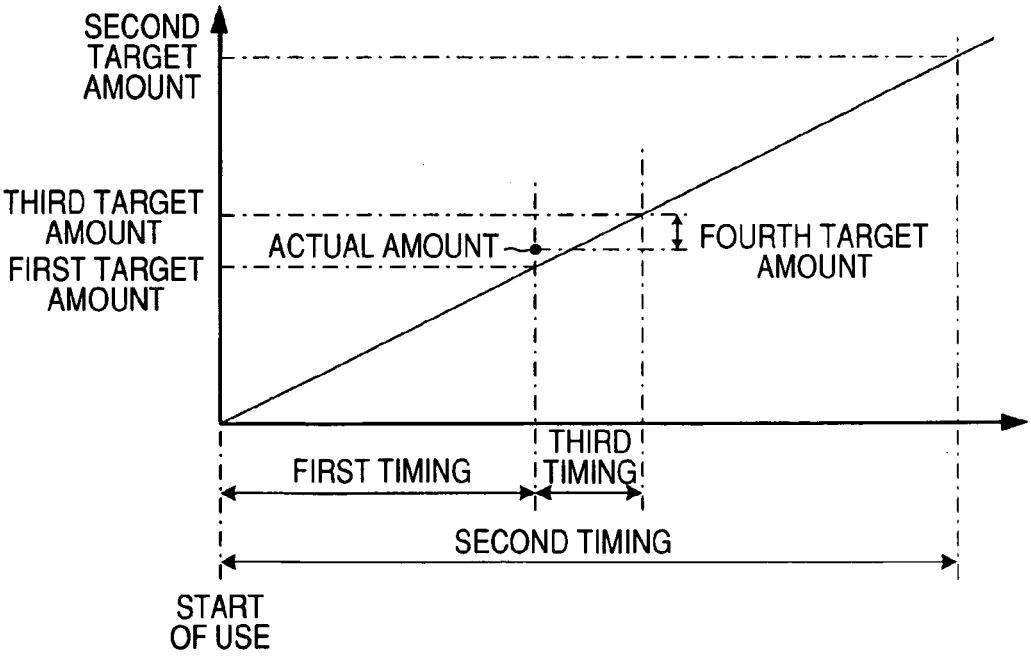
FIG. 9 is a graph showing relationships among set time periods, a target of consumption amount of the colorant, an actual amount, and a fourth target amount.

As shown in FIG. 6B, the save canceling threshold TH1, the save setting/inhibition canceling threshold TH2, and the inhibition setting threshold TH3 are set to respectively have values which are increased from the target of consumption amount of the colorant MS(t) by different given values, and set to be TH3>TH2>TH1.

As a result of the processes of S370 to S440, in the case where the actual amount RS(t) exceeds the save setting/inhibition canceling threshold TH2 when the operation mode is the normal mode, the operation mode is switched to the toner save mode, and in the case where the actual amount RS(t) exceeds the inhibition setting threshold TH3 when the operation mode is the normal mode or the toner save mode, the operation mode is switched to the inhibition mode.

In the case where the actual amount RS(t) is smaller than the save setting/inhibition canceling threshold TH2 when the operation mode is the inhibition mode, the operation mode is switched to the toner save mode, and in the case where the actual amount RS(t) is smaller than the save canceling threshold TH1 when the operation mode is the inhibition mode or the toner save mode, the operation mode is switched to the normal mode. In cases other than those as described above, the set operation mode is maintained.

Namely, the use of the thresholds TH1 to TH3 allows the switching of the operation mode to have hysteresis.

FIG. 6B is a diagram illustrating the manner of switching the operation mode in accordance with a change of the actual amount. As shown in FIG. 6B, at the timing of the elapsed time period t when the actual amount RS(t) is equal to or smaller than the save canceling threshold TH1, the operation mode is set to the normal mode. At the timing of the elapsed time period t+T when the actual amount RS(t+T) is larger than the save setting/inhibition canceling threshold TH2, the operation mode is switched to the toner save mode, and at the timing of the elapsed time period t+2T when the actual amount RS(t+2T) is larger than the inhibition setting threshold TH3, the operation mode is switched to the inhibition mode. Thereafter, at the timing of the elapsed time period t+4T when the actual amount RS(t+4T) is smaller than the save setting/inhibition canceling threshold TH2, the operation mode is switched to the toner save mode, and at the timing of the elapsed time period t+7T when the actual amount RS(t+7T) is smaller than the save canceling threshold TH1, the operation mode is switched to the normal mode.

Figure 5:
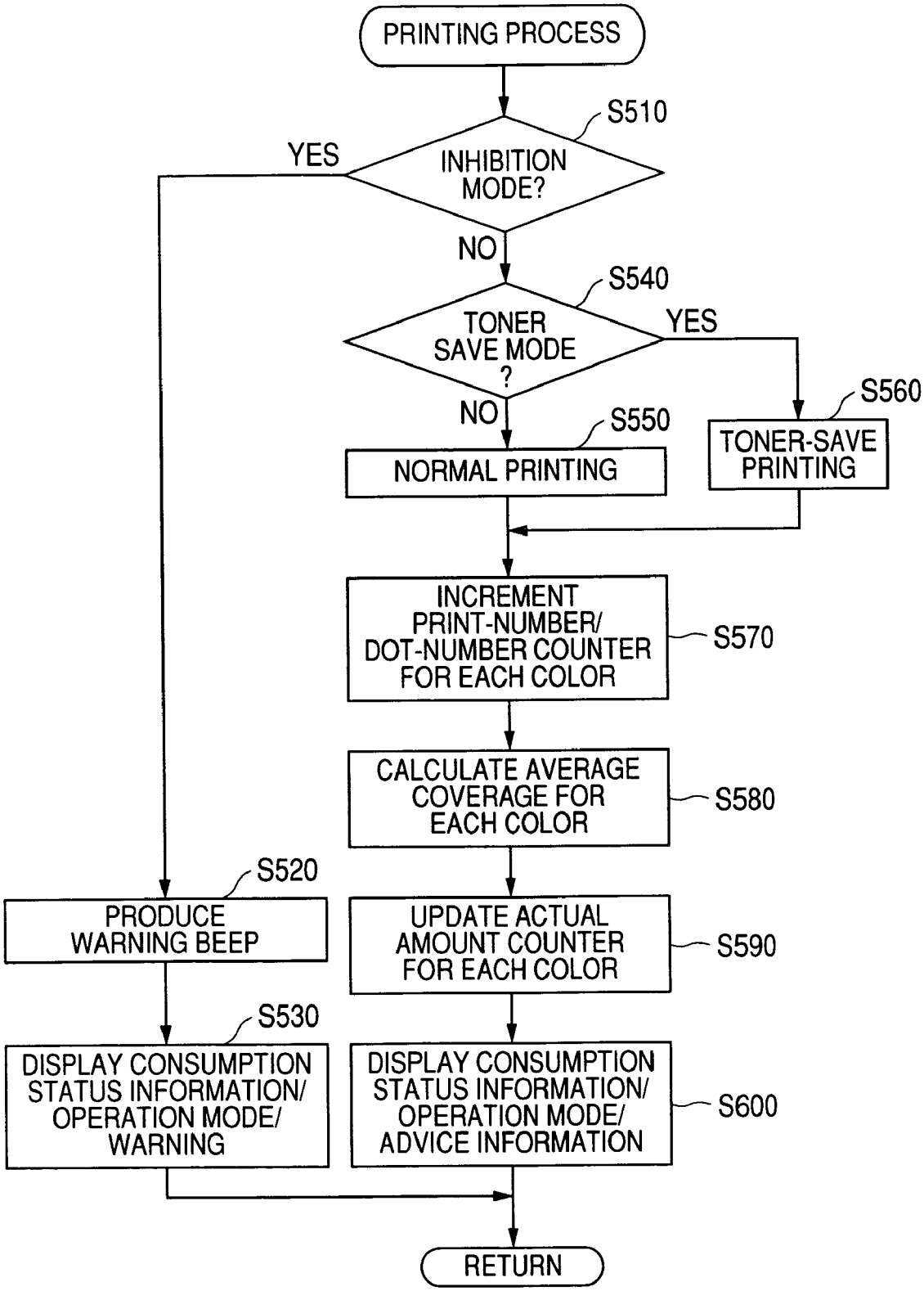
FIG. 5 is a flowchart showing in detail a printing process.

Next, the printing process which is executed in S160 will be described in detail with reference to a flowchart shown in FIG. 5. This process is activated when the print request is issued as described above.

When the process is activated, it is first determined in S510 whether or not the currently set operation mode is the inhibition mode. If it is determined that the operation mode is the inhibition mode, the control transfers to S520 to cause the speaker constituting the announcing unit 5 to produce a warning beep, and, subsequently in S530, a warning display indicative of the current operation mode or the inhibition of the image formation is displayed together with the consumption status information on the display device constituting the announcing unit 5. Then, the process is ended.

If it is previously determined in S510 that the currently set operation mode is not the inhibition mode, the control transfers to S540 to determine whether the currently set operation mode is the toner save mode or not. If it is determined that the operation mode is not the toner save mode, the control transfers to S550 to cause the printing unit 7 to perform the normal image formation, and then proceeds to S570. By contrast, if the operation mode is the toner save mode, the control transfers to S560 to cause the printing unit 7 to perform the toner-save image formation in which the dot density is reduced, and then proceeds to S570.

In S570, in accordance with contents of the printing in S550 or S560, the print-number counter and the dot-number counter are incremented for each of the toner colors (for each of the toner cartridges 6). Subsequently in S580, an average coverage is calculated for each color on the basis of the count values of the print-number counter and dot-number counter, or the past information stored in the history information region 15*c*. Then, the control proceeds to S590.

In S590, the actual amount required in this printing is calculated for each of the toner colors from the number of printed sheets in S550 or S560, and the average coverage calculated in S580, and the calculated actual amount is added to the actual amount counter, thereby updating the actual amount counter which is disposed for each of the toner colors. Subsequently in S600, the consumption status information and advice information which are previously produced in S360, and the current operation mode are displayed on the display device constituting the announcing unit 5, and this process is ended.

In S530 and S600, the consumption status information and advice information which are produced in S360 are displayed. Alternatively, processes similar to those of S310 to S360 may be executed at each display timing so that latest consumption status information and advice information are displayed.

As described above, in the printer 1, at each warning process execution timing, i.e., at each time the unit time period T has elapsed after start of use of the toner cartridge 6, the target of consumption amount of the colorant MS(t) at the timing of the elapsed time period t (t=T, 2T, 3T, . . . ) is set in accordance with the preset consumption rate SP, the actual amount RS(t) at the timing is obtained, and the consumption status information in which the target of consumption amount of the colorant MS(t) per unit time period T is compared to the actual amount RS(t) per unit time period T is announced.

According to the printer 1, at each elapsed unit time period T, the user can know the rate at which the toner is consumed. As a result, it is possible to support the user to achieve the toner consumption target (only the consumption target value M(TK) is consumed during the target time period TK).

The printer 1 is configured so that, at each warning process execution timing, the target of consumption amount of the colorant MS(t+T) at the next warning process execution timing is calculated, advice information is produced in which the difference between the current actual amount RS(t) and the target of consumption amount of the colorant MS(t+T) is indicated as the fourth target amount SS for the next warning process execution timing is produced, and the advice information.

When the actual amount RS(t) at the present timing (the elapsed time period t) exceeds the target of consumption amount of the colorant MS(t), the consumption rate at which the deviation can be eliminated at the warning process execution timing (the elapsed time period t+T) is announced.

According to the printer 1, therefore, it is possible to guide the user's operation more positively so that the actual amount RS(t) approaches a desired target of consumption amount of the colorant (the target of consumption amount of the colorant MS(t)) which is necessary for achieving the target.

The printer 1 is configured so that when the toner cartridge 6 is replaced, the actual amount (the count value of the actual amount counter at the time of replacement during the whole usage time period of the toner cartridge 6 which was mounted before the time of replacement) is stored, and a default value of the consumption target value M(TK) is automatically set on the basis of the stored actual amount.

According to the printer 1, therefore, the target of consumption amount of the colorant MS(t) which is necessary for maintaining the past consumption rate can be automatically set on the basis of the default value of the consumption target value M(TK).

The printer 1 is configured so that, when the deviation amount (excess amount) DS of the actual amount RS(t) with respect to the target of consumption amount of the colorant MS(t) is larger than the save setting/inhibition canceling threshold TH2, the operation mode of the printing unit 7 is switched to the toner save mode in which the image formation is performed while suppressing the consumption amount of the toner, and when the deviation amount is larger than the inhibition setting threshold TH3 that is larger than the save setting/inhibition canceling threshold TH2, the operation mode of the printing unit 7 is switched to the inhibition mode in which the image formation is inhibited.

According to the printer 1, even when conscious suppression of the number of image formations is not conducted, the consumption amount of the colorant is compulsively suppressed in the toner save mode. Accordingly, the actual amount RS(t) can be made close to the target of consumption amount of the colorant MS(t) without imposing a burden on the user. Since the toner is not consumed in the inhibition mode, the actual amount RS(t) can be surely made close to the target of consumption amount of the colorant MS(t).

In one aspect as an example, S320 corresponds to the determining unit, S310 corresponds to the first calculating unit, the announcing unit 5, S360, S450, S530, and S600 correspond to the announcing unit, S350 corresponds to the second calculating unit, S210 corresponds to the storage unit, S570 to S590 correspond to the image forming amount detecting unit, S370 to S440 correspond to the operation mode switching unit and the actual amount, and the printing unit 7, S550, and S560 correspond to the printing unit.

Although aspects of the invention have been described, the invention is not restricted to the above-described aspects, and can be variously implemented without departing from the spirit of the invention.

In one aspect, when the target of consumption amount of the colorant MS(t), the actual amount RS(t), or the fourth target amount SS is announced, it is displayed as a percentage. Alternatively, it may be displayed by the number of printed sheets or that of printable sheets, on the basis of the average coverage.

In one aspect, the actual amount of the toner is obtained on the basis of the number of printed sheets and the average coverage. Alternatively, as shown by the broken line in FIG. 1A, a remaining-amount sensor 9*b* serving as the remaining-amount detecting unit for directly detecting the remaining amount of the toner may be disposed in the detecting unit 9, and the actual amount may be obtained from a result of the detection by the remaining-amount sensor 9*b*. In the alternative, the remaining amount of the colorant is directly detected, and hence the actual amount can be detected more accurately.

In one aspect, the target of consumption amount of the colorant MS(t) is automatically set so as to indicate a given consumption rate SP which is specified by the target time period TK and the consumption target value M(TK). However, it is not always necessary to set the target of consumption amount of the colorant MS(t) so as to indicate a given consumption rate. The target of consumption amount of the colorant MS(t) may be manually set so as to indicate an arbitrary consumption rate.

In one aspect, only one toner save mode is used. Alternatively, plural toner save modes may be used. In such a case, in place of the inhibition mode, an operation mode which is similar to or equivalent to the inhibition mode may be realized by setting the dot density in the printing to zero.

An aspect in which the colorant is a toner has been described. Alternatively, the colorant may be an ink.

In one aspect, the CPU 11 of the printer 1 executes both the cartridge replacement process and the consumption rate warning process. Alternatively, part or all of the processes may be executed by an information processing apparatus connected through the communication I/F 19. In the alternative, the announcement to the user is not restricted to that performed by the announcing unit 5 of the printer 1, and may be performed by a display device or audio device which is disposed in the information processing apparatus, or by using another apparatus connected to the network.

What is claimed is:

1. A monitoring apparatus comprising:

a determining unit that determines in advance a first target amount, which is determined as a target of consumption amount of a colorant at a first timing based on a target time indicating a desired usage period of the colorant, at which a first predetermined period from start of use of the colorant in image formation has elapsed;

a timer that measures a time from start of use of the colorant in image formation;

a first calculating unit that calculates an actual amount of the colorant actually consumed while the timer measures the first predetermined period; and an announcing unit that announces consumption status information generated by comparing the first target amount and the actual amount, wherein the determining unit determines the first target amount based on a second target amount, which is determined as a target of consumption amount of the colorant at a second timing, at which a second predetermined period from start of use of the colorant in image formation has elapsed, the second predetermined period being longer than the first predetermined period.

2. A monitoring apparatus according to claim 1, further comprising a second calculating unit that calculates a third target amount based on the first target amount, the third target amount being determined as a target of consumption amount of the colorant at a third timing, at which a third predetermined period has elapsed, wherein the announcing unit announces a fourth target amount and the third predetermined period, the fourth target amount being a difference between the actual amount and the third target amount.

3. A monitoring apparatus according to claim 1, further comprising a storage unit that stores a designated period and consumption amount of the colorant consumed during the designated period, wherein the determining unit determines the first target amount based on the designated period and the consumption amount in the storage unit.

4. A monitoring apparatus according to claim 1, further comprising a remaining-amount detecting unit that detects a remaining amount of the colorant remaining in a colorant cartridge, wherein the first calculating unit calculates the actual amount based on the remaining amount.

5. A monitoring apparatus according to claim 1, further comprising an image forming amount detecting unit that detects an image forming amount by the colorant, wherein the first calculating unit calculates the actual amount based on the image forming amount.

6. A monitoring apparatus according to claim 1, further comprising a switcher that places an operation mode into a save mode, in which the image formation is performed while suppressing the consumption amount of the colorant, if a difference between the actual amount and the first target amount exceeds a first threshold.

7. A monitoring apparatus according to claim 6, wherein the switcher places the operation mode into an inhibition mode that inhibits the image formation, when the difference exceeds a second threshold larger than the first threshold.

8. An image forming apparatus comprising:

a colorant cartridge that accommodates a colorant;

a printing unit that prints an image onto a recording medium by using the colorant;

a determining unit that determines in advance a first target amount, which is determined as a target of consumption amount of the colorant at a first timing based on a target time indicating a desired usage period of the colorant, at which a first predetermined period from start of use of the colorant in image formation has elapsed;

a timer that measures a time from start of use of the colorant in image formation;

a first calculating unit that calculates an actual amount of the colorant actually consumed while the timer measures the first predetermined period; and an announcing unit that announces consumption status information generated by comparing the first target amount and the actual amount, wherein the determining unit determines the first target amount based on a second target amount, which is determined as a target of consumption amount of the colorant at a second timing, at which a second predetermined period from start of use of the colorant in image formation has elapsed, the second predetermined period being longer than the first predetermined period.

9. An image forming apparatus according to claim 8, further comprising a plurality of the colorant cartridges, wherein the announcing unit announces the consumption status information for each of the colorant cartridges.

10. An image forming system comprising:

an image forming apparatus including a colorant cartridge which accommodates a colorant, and a printing unit that prints an image onto a recording medium by using the colorant;

an information processing apparatus which performs data communication with the image forming apparatus;

a determining unit that determines in advance a first target amount, which is determined as a target of consumption amount of the colorant at a first timing based on a target time indicating a desired usage period of the colorant, at which a first predetermined period from start of use of the colorant in image formation has elapsed;

a timer that measures a time from start of use of the colorant in image formation;

a first calculating unit that calculates an actual amount of the colorant actually consumed while the timer measures the first predetermined period; and an announcing unit that announces consumption status information generated by comparing the first target amount and the actual amount, wherein the determining unit determines the first target amount based on a second target amount, which is determined as a target of consumption amount of the colorant at a second timing, at which a second predetermined period from start of use of the colorant in image formation has elapsed, the second predetermined period being longer than the first predetermined period.

* * * * *